US006571503B2

(12) United States Patent
Thorpe

(10) Patent No.: US 6,571,503 B2
(45) Date of Patent: Jun. 3, 2003

(54) FIREARM MOUNTED ILLUMINATION DEVICE

(76) Inventor: Jeffrey C. Thorpe, 6 Charles River Rd., Medway, MA (US) 02053

( * ) Notice: Subject to any disclaimer, the term of this patent is extended or adjusted under 35 U.S.C. 154(b) by 94 days.

(21) Appl. No.: 09/764,227

(22) Filed: Jan. 16, 2001

(65) Prior Publication Data

US 2002/0148153 A1 Oct. 17, 2002

(51) Int. Cl.[7] ..... F41G 1/00
(52) U.S. Cl. ..... 42/114; 42/117; 42/146
(58) Field of Search ..... 42/146, 114, 117

(56) References Cited

U.S. PATENT DOCUMENTS

| | | | | | |
|---|---|---|---|---|---|
| 4,233,770 | A | * | 11/1980 | de Filippis et al. | 42/114 |
| 4,542,447 | A | * | 9/1985 | Quakenbush | 200/60 |
| 4,777,754 | A | | 10/1988 | Reynolds, Jr. | 42/103 |
| 4,856,218 | A | | 8/1989 | Reynolds, Jr. | 42/103 |
| 5,107,612 | A | * | 4/1992 | Bechtel | 42/115 |
| 5,282,594 | A | * | 2/1994 | Huang | 248/205.1 |
| 5,400,540 | A | | 3/1995 | Solinsky et al. | 42/103 |
| 5,430,967 | A | | 7/1995 | Woodman, III et al. | 42/103 |
| 5,522,167 | A | | 6/1996 | Teetzel | 42/103 |
| 5,560,730 | A | | 10/1996 | Capps, III | 362/110 |
| 5,581,898 | A | * | 12/1996 | Thummel | 42/114 |
| 5,584,137 | A | * | 12/1996 | Teetzel | 362/114 |
| 5,590,486 | A | * | 1/1997 | Moore | 362/110 |
| 5,654,594 | A | | 8/1997 | Bjornsen, III et al. | 307/115 |
| 5,685,105 | A | | 11/1997 | Teetzel | 42/103 |
| 5,758,448 | A | * | 6/1998 | Thummel | 362/114 |
| 6,345,464 | B1 | * | 2/2002 | Kim et al. | 200/518 |

* cited by examiner

*Primary Examiner*—Charles T. Jordan
*Assistant Examiner*—Denise Buckley
(74) *Attorney, Agent, or Firm*—Geoffrey E. Dobbin

(57) ABSTRACT

A firearm mounted illumination device whereby the device is mounted underneath the barrel of a firearm. The particular mounting point is the trigger guard of the weapon, eliminating the need to modify the weapon or to have an already existing mounting rail system. The activation switch is a compression switch located underneath the trigger guard of the fire arm so as to allow a user to activate the device without altering his or her grip on the weapon and without extensive additional training in the use of the device in conjunction with the weapon. The device also provides a dual switching mechanism, so as to allow for continuous activation of the device, and a low power indication feature.

8 Claims, 7 Drawing Sheets

FIREARM MOUNTED ILLUMINATION DEVICE

FIELD OF INVENTION

The present invention relates to firearm mounted illumination devices and particularly related to an illumination device mounted on the trigger guard of a firearm while providing a convenient touch switch for instant activation

BACKGROUND OF THE INVENTION

The use of illumination devices to aid in marksmanship and personal defense is known in the prior art. Lights have been mounted, generally, in three locations on a weapon: on the barrel, underneath the barrel, and on the magazine. These illumination devices, while suitable for their individual purposes are not suitable for the purpose of the present invention, namely providing an illumination device that is mountable on any handgun and allows for holstering the weapon without removal of the device and activation of the device without altering the user's grip on the weapon. For example: U.S. Pat. No. 5,685,105 to Teetzel (1997); U.S. Pat. No. 5,654,594 to Bjornsen, III, et al. (1997); U.S. Pat. No. 5,560,703 to Capps, III (1996), U.S. Pat. No. 5,522,167 to Teetzel (1996); U.S. Pat. No. 5,430,967 to Woodman, III, et al. (1995); U.S. Pat. No. 5,400,540 to Solinsky, et al. (1995); and U.S. Pat. No. 4,856,218 to Reynolds, Jr. are all illustrative of the prior art.

JAMES W. TEETZEL

APPARATUS FOR ATTACHING A FLASHLIGHT TO A FIREARM

U.S. Pat. No. 5,685,105

Teetzel teaches a flashlight mounting module that may be mounted on the underside of a handheld firearm. Switches and the power source are contained in specially modified handgrips. The module is attached by using an attached railing system to connect a mount adapter and a dovetail interface to attach the flashlight module to the mount adapter.

BERNIE E. BJORNSEN, III, ET AL.

ERGONOMIC ELECTRICAL CURRENT SWITCHING SYSTEMS

U.S. Pat. No. 5,654,594

The Bjornsen patent teaches the use of a "touch switch" whereby current is carried by two conductive strips. The strips are normally separated, however, when squeezed together they complete a circuit. The '594 patent claims the use of such a switch on the handle of a weapon.

LEWIS W. CAPPS, III

HANDGUN LIGHT MOUNT

U.S. Pat. No. 5,560,703

This invention discloses a mount for a flashlight positioned on the bottom of a weapon's magazine.

JAMES W. TEETZEL

SWITCH APPARATUS

U.S. Pat No. 5,522,167

The switching appetites disclosed in this invention uses a tritium vial, embedded on the posterior side of the trigger guard/grip, a hole bored through the trigger, and a sensor on the anterior side of the trigger guard area. The sensor reads the emissions from the vial, through the hole. When the user places his finger on the trigger, and correspondingly over the hole, the sensor reads a drop in the emissions and activates the flashlight.

WALLACE E. WOODMAN, III, ET AL.

AIMING ASSISTANCE DEVICE FOR A WEAPON

U.S. Pat. No. 5,430,967

The mounting structure for this invention utilizes mounting rails on the underside of the weapon's barrel. It teaches a side opening structure to allow the user to mount the structure on the rails

KENNETH S. SOLINSKY, ET AL.

AIMING LIGHT AND MOUNTING ASSEMBLY THEREFORE.

U.S. Pat. No. 5,400,540

The invention teaches a multi-positioning switch for a light mounted on the side of a rifle barrel. The switch is positioned for maximum convenience of the rifle user at approximately where a user's forward arm would hold the rifle.

EDWARD C. REYNOLDS, JR.

LIGHT BEAM ASSISTED AIMING OF FIREARMS

U.S. Pat. No. 4,856,218

The invention discloses a light beam emitting assembly mounted underneath the barrel of a rifle or pistol. The assembly of the mount to the weapon requires the replacement of certain parts of the weapon with others that will similarly function and simultaneously hold the light housing.

EDWARD C. REYNOLDS, JR.

LIGHT BEAM ASSISTED AIMING OF FIREARMS

U.S. Pat. No. 4,777,754

This invention, also by Reynolds, Jr., also replaces parts of the weapon for others that will perform similarly while holding the light housing.

While the aforementioned inventions accomplish their individual objectives, they are not suitable for the purpose of this invention, namely to provide a universally adaptable, slim line, firearm mounted illumination device with a dual switch mechanism that is activated by a switch positioned directly underneath the trigger guard The '594 patent discloses a similar switching mechanism; however, the activation mechanism is located on the grip of the weapon, not underneath the trigger guard. As such, it would be more prone to accidental activation and would require adaptation to match different lengths with different pistols and illumination devices. The '105, and '967 patents disclose under barrel mounted illumination devices and targeting aids; but, all of the devices require mounting on an existing or added rail system. The '218 and '754 patents disclose replacing parts of the weapon in order to mount the claimed aiming devices. Many devices, including the '703 patent, are simple mounts that require a generic or specialized flashlight and do not provide a switching mechanism. Other devices, such as the '167 and '105 patents mount switches on the weapon. These devices, however, require relatively extensive modification of the weapon. None of the inventions disclosed also provides a dual switching system including a compression or "touch" switch located directly underneath the trigger guard of a pistol. None of the disclosed inventions disclose a mounting means focused on the trigger guard of the weapon, a universal component. In this respect, the illumination device according to the present invention departs substantially from the usual designs in the prior art. The device mounts directly onto the trigger guard of any firearm. The dual switch features a compression switch and a master switch. In doing so, this invention provides a new and useful light that not only is usable on any handheld firearm, but also provides a conveniently located compression switch, allowing for activation without altering a user's grip, and therefore allowing greater concentration on the user's target, and a master power switch for continuous activation if the user so desires.

SUMMARY OF THE INVENTION

In view of the foregoing disadvantages inherent in the known types of illumination devices, this invention provides an improved illumination device for hand held firearms. As such, the present invention's general purpose is to provide a new and improved defense light that will be useful on any handheld firearm without modification of said firearm while presenting a new and useful switching mechanism that allows for instant illumination when desired by the user.

The defense light comprises a battery and light housing that is ideally aligned along the barrel of a pistol. Towards the rear portion of the housing, away from the light is a mounting means. The mounting means attaches the housing to the front portion of the pistol's trigger guard and holds the housing securely against the trigger guard and barrel of the pistol. The housing also features an appendage extending rearward, from beneath the mounting means. The appendage contains the touch switch device and is shaped and sized to correspond to the trigger guard of the pistol. The housing also features a master switch for continuous activation of the light. Due to the location of the light and switch relative to the weapon, many advantages are provided by this invention over the prior art. The foremost of which is that a user need not relearn firing techniques. In order to activate the light, the user need only press the touch switch with the fingers already located against the trigger guard, and also, therefore, already against the touch switch. As such, there is no need to deviate from the recommended two-handed firing position. The central location, under the barrel, is also convenient for both left and right handed users. No modification to the weapon is required as with some illumination devices and the defense light according to the present invention also does not interfere with magazine changes as magazine mounted lighting devices may do. The size and positioning of the defense light according to the present invention also does not interfere with holstering, allowing the user to maintain attachment of the device indefinitely and conveniently.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide a defense light for use on all handheld firearms.

It is another object of the invention to provide a defense light with a dual switching system, including both a master switch and instantaneous touch switch.

It is yet another object of the invention to provide a defense light with a switch positioned and designed in such a way as to allow the use of the light without modifying the user's grip or training to use the light and weapon together.

It is still another object of the invention to provide a small and compact defense light that with not interfere with holstering, unholstering, or reloading the weapon.

It is a further object of the invention to provide a defense light that is fully ambidextrous.

It is a still further object of the invention to provide a defense light that is simple to use and economical to manufacture.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
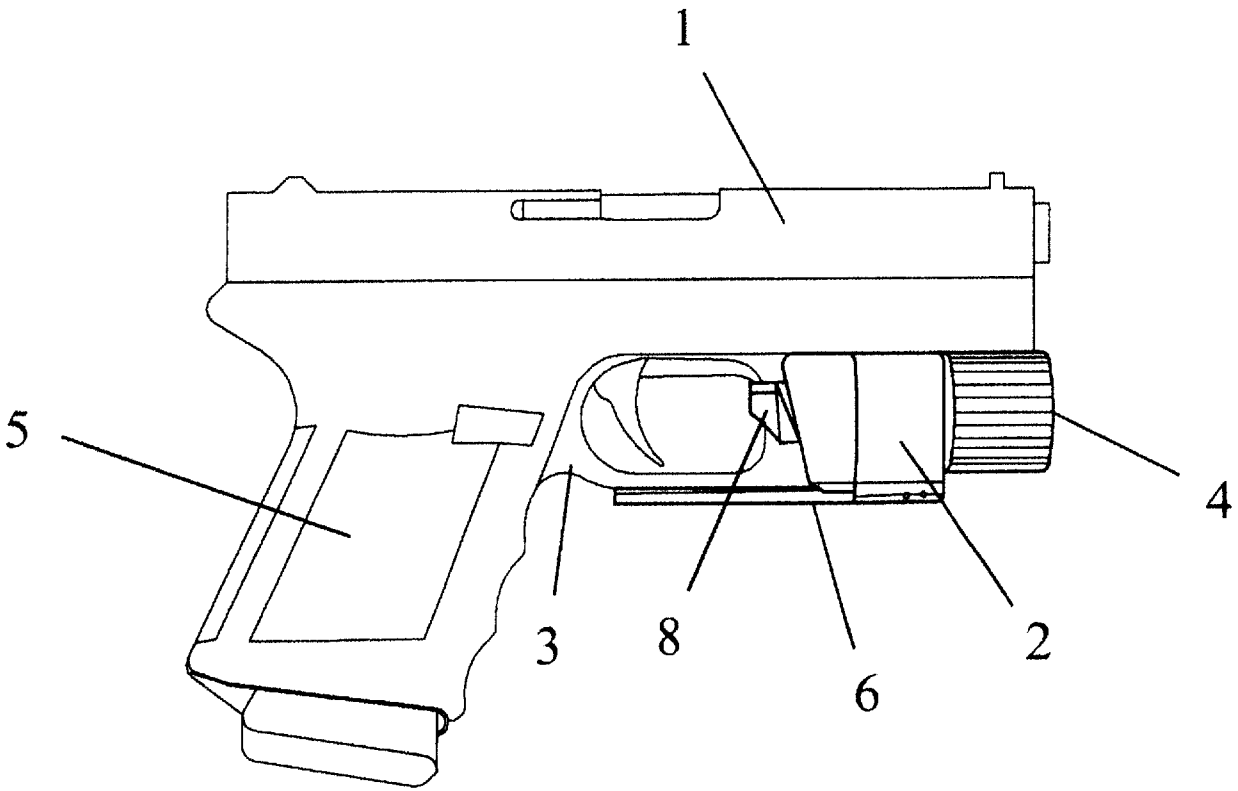
FIG. 1 is a perspective view of the invention mounted on a pistol.
Figure 2:
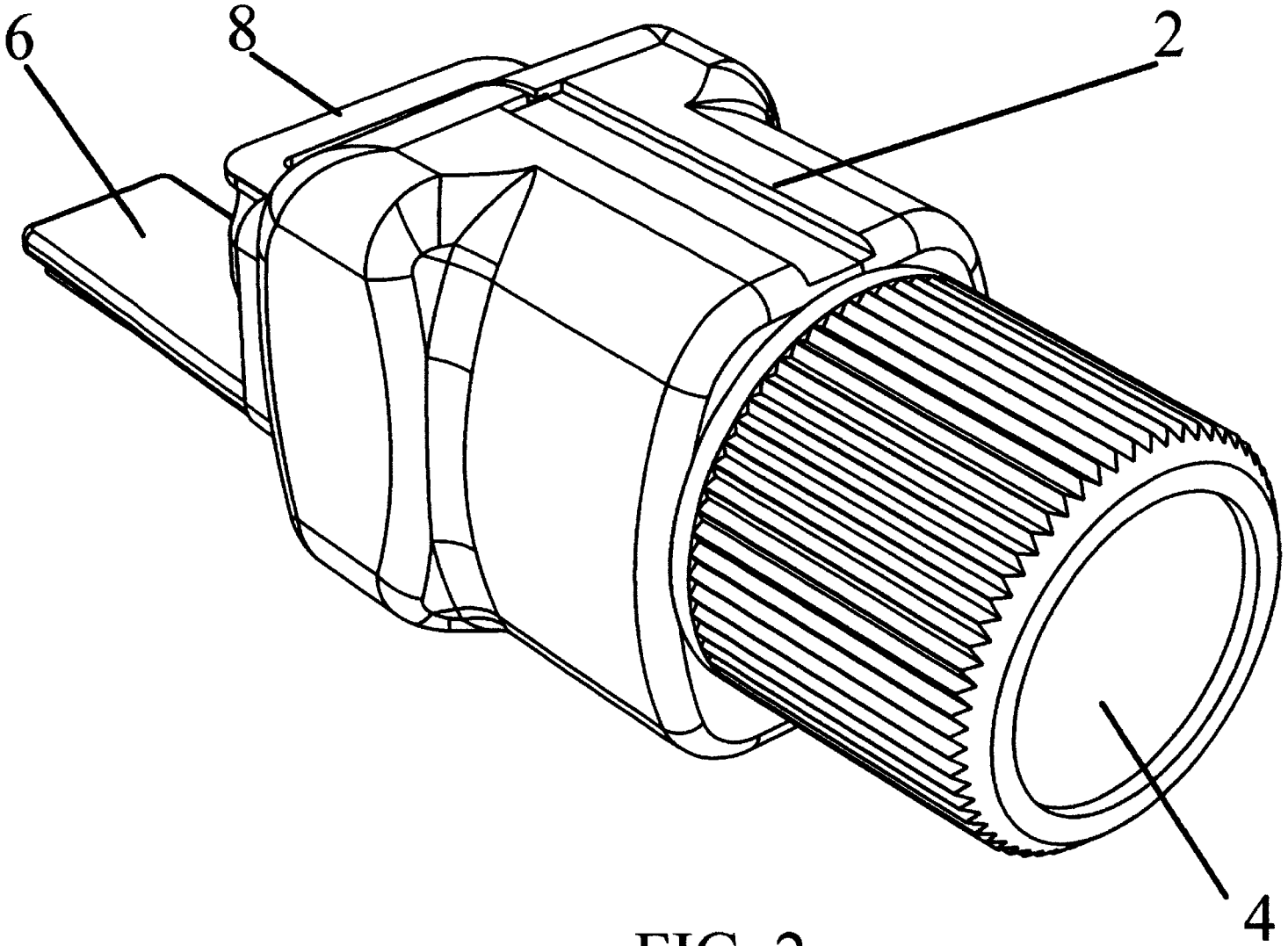
FIG. 2 is a front perspective view of the invention.
Figure 8:
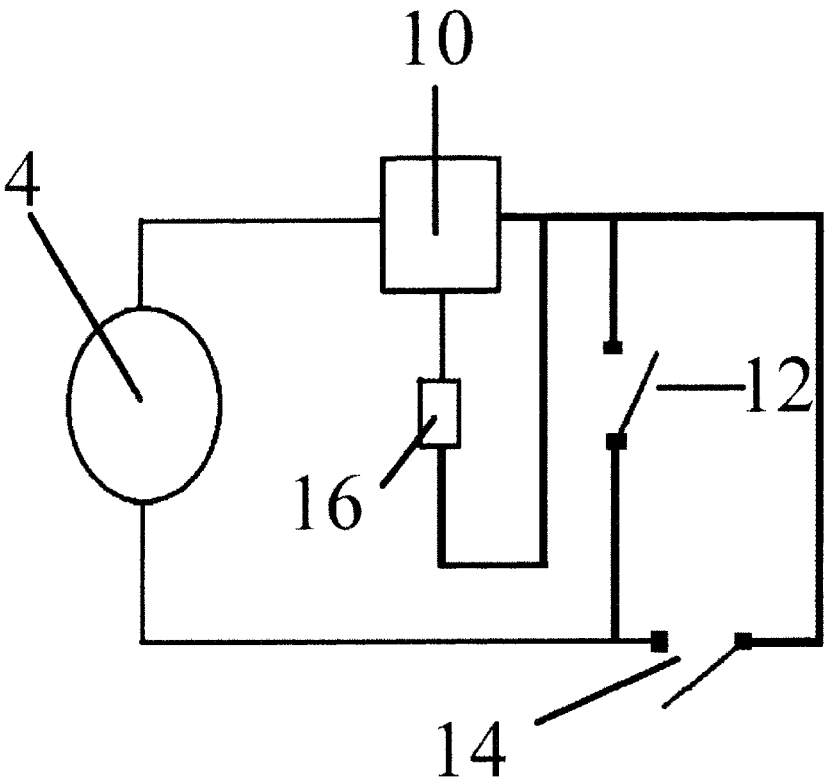
FIG. 8 is a diagram of the switching mechanism of the invention.

With reference now to the drawings, the preferred embodiment of the defense light shall be described herein. As noted in FIG. 1, the invention relates to a small light that is mounted underneath the barrel of a hand held pistol. Generally, housing 2 contains a light 4, battery 10 and two switching mechanisms 12, 14, shown schematically in FIG. 8. Extending from the rear of housing 2 is a switch appendage 6 and a mounting appendage 8. Housing 2 is positioned underneath the barrel 1 and in front of the trigger guard 3 of the pistol. While the upper side of housing 2 is abutting barrel 1, mounting appendage 4 is fastened around the forepart of trigger guard 3. The switching appendage 6 extends from the lower side of housing 2 along the lower part of trigger guard 3 towards the grip 5. Housing 2, including the appendages 6 and 8, should be constructed of a rigid, inert material, such as a hard plastic or metal.

Figure 5:
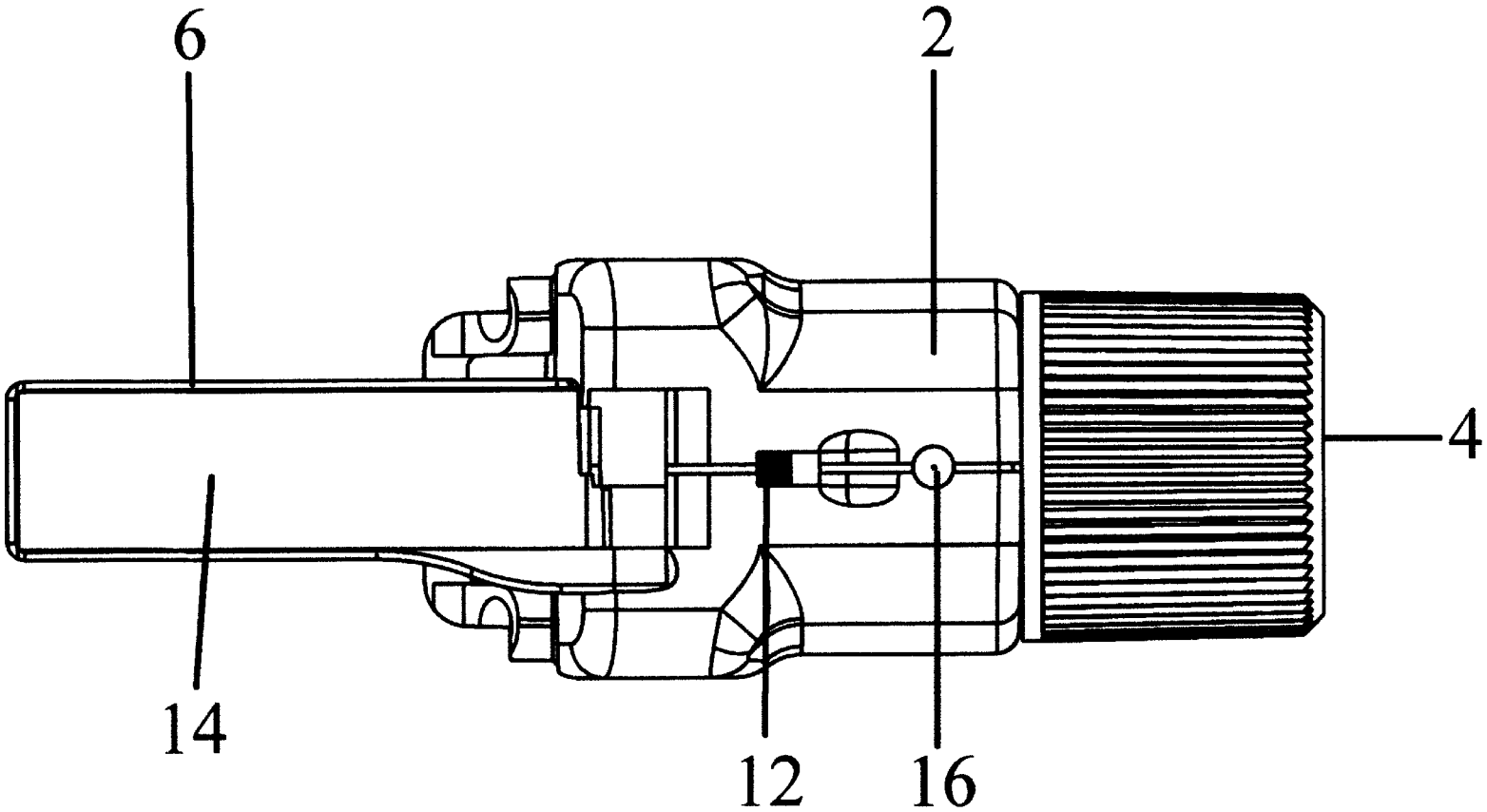
FIG. 5 is a bottom plan view of the invention.
Figure 6:
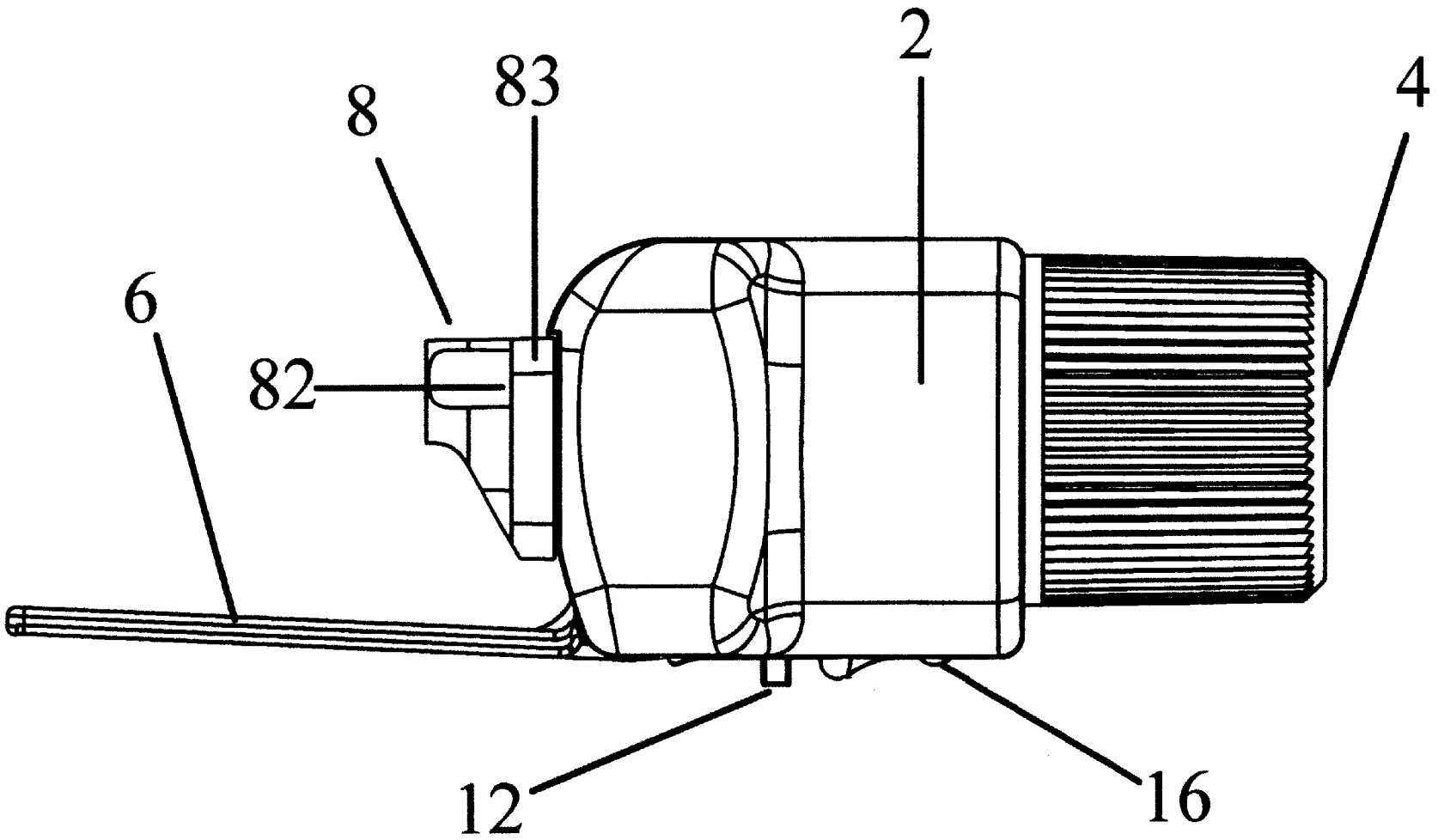
FIG. 6 is a side plan view of the invention.

Referring to FIG. 5, the preferred embodiment of the defense light has a master slide switch 12, a compression switch 14, and a low power indicator 16, which is located within switch appendage 6. Since the circuit activating light 4 is a simple circuit, having two alternate routings other than low power indicator, either master switch 10 and compression switch 14 must be closed to activate light 4, shown in FIG. 9. Switch appendage 6 should be slightly hollowed out on the lower side so as to accommodate compression switch 14. Compression switch 14 should be slightly raised from the level of switch appendage 6 when installed, so as to allow the user to compress the switch. If a user desires to use the defense light, he either simply closes master slide switch 10 at a convenient time or, when necessary, the user then compresses compression switch 14. Such compression touches two strips of conductive material together and completes the circuit, thus activating light 4.

Figure 3:
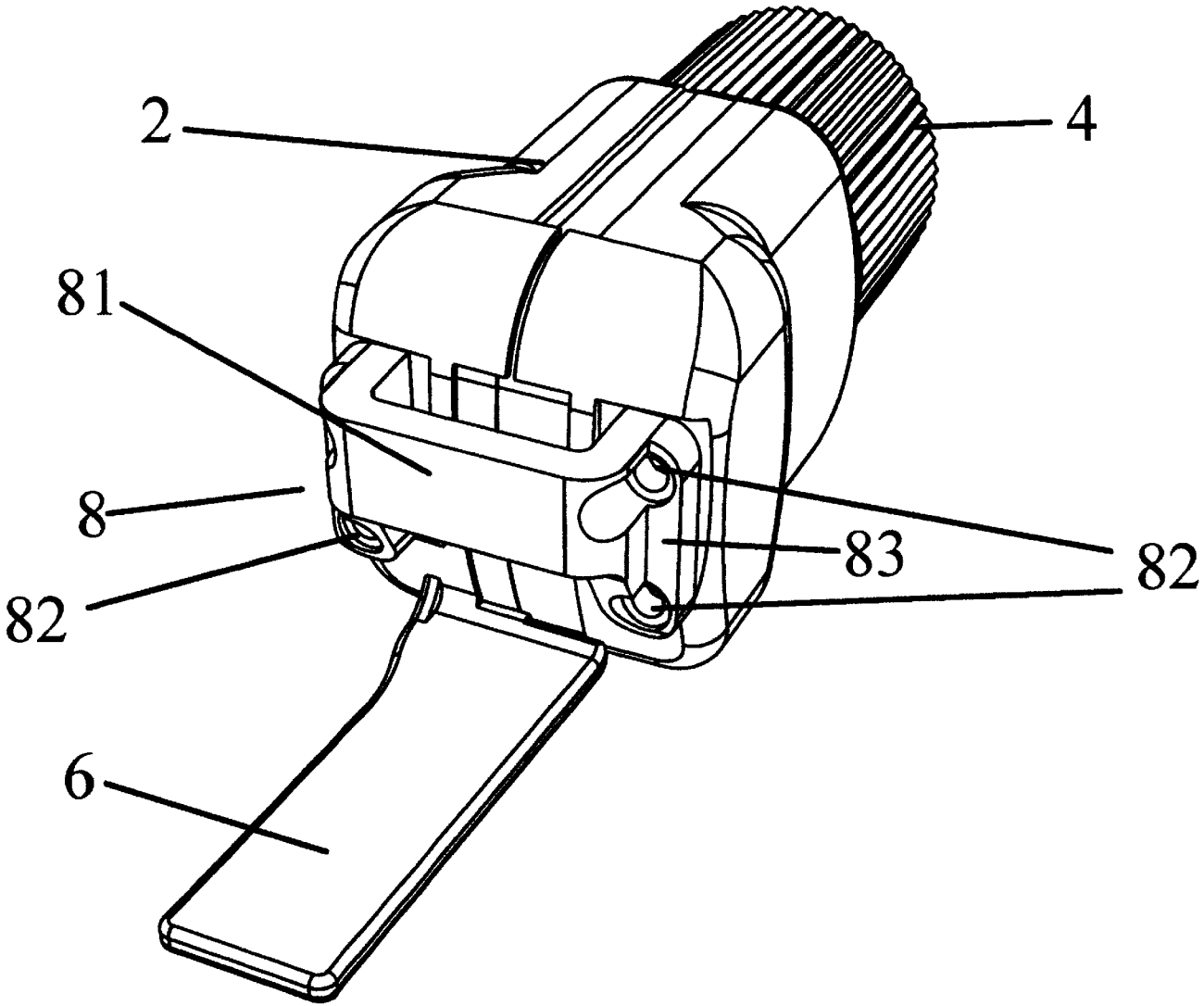
FIG. 3 is a rear perspective view of the invention.
Figure 4:
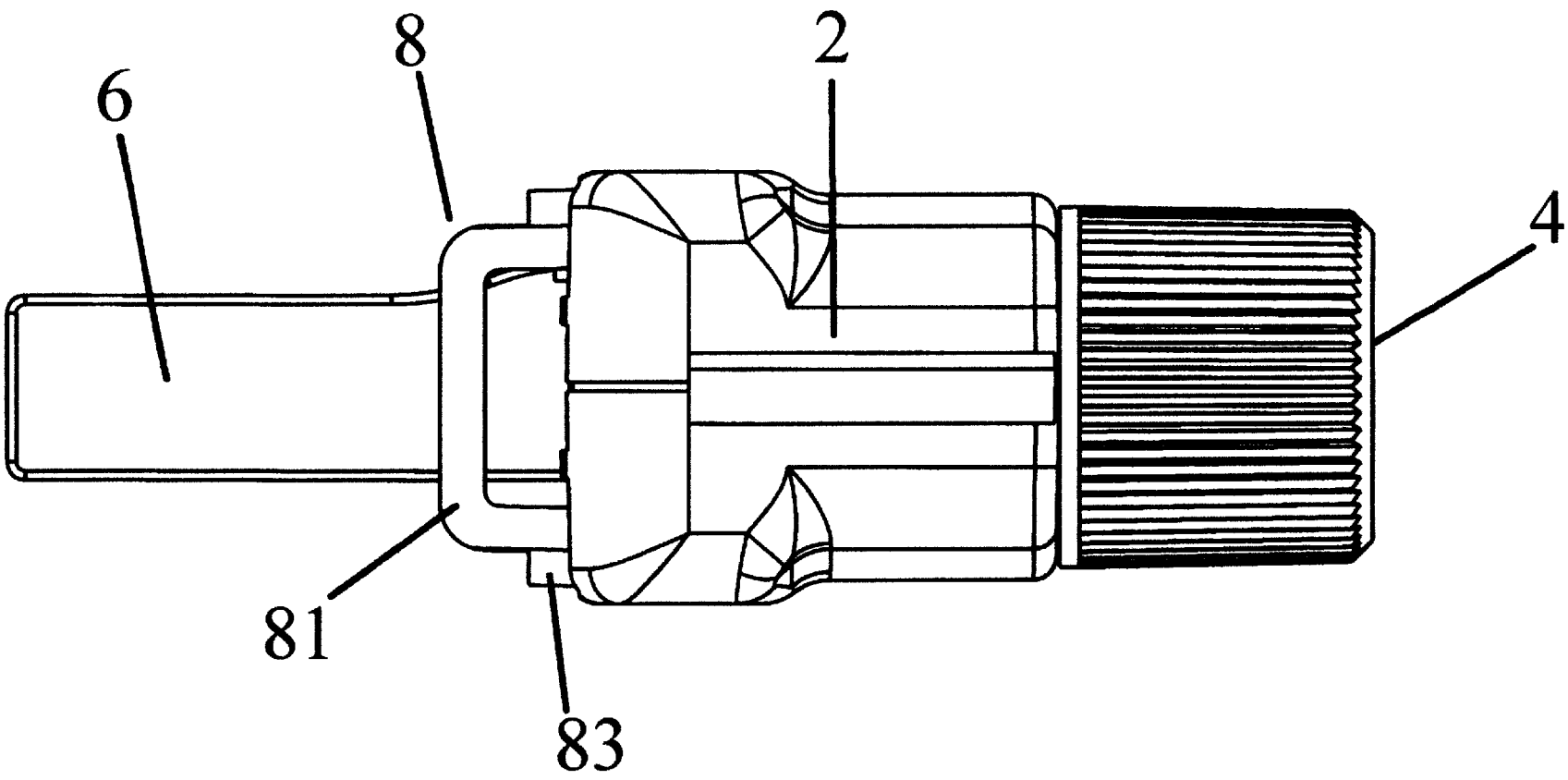
FIG. 4 is a top plan view of the invention.
Figure 7:
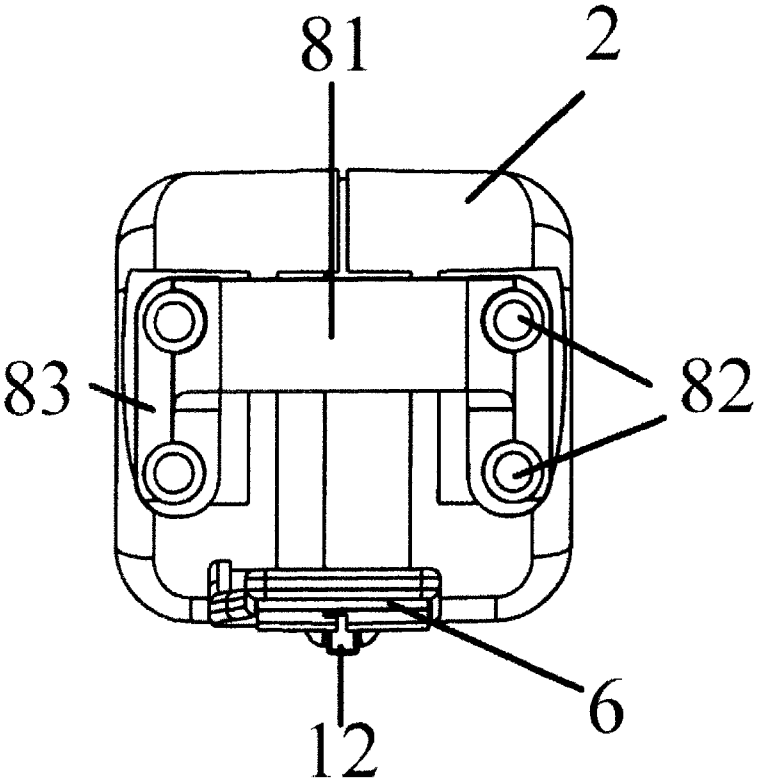
FIG. 7 is a rear plan view of the invention.

The mounting appendage 8, shown in FIGS. 3 and 7, is, ideally, a band of rigid material 81 which is attached to housing 2 by an affixing means, such as the bolts 82 shown in FIGS. 3 and 7. When installing the defense light, housing 2 should be positioned to abut the pistol's barrel 3 and trigger guard 5. Band 81 should then be placed on the inside of trigger guard 5 with its connecting mounts 83 towards the housing. Bolts 82 should then be inserted through provided holes in the mounts and screwed into corresponding holes in housing 2. This is not, however, the only means of attaching the housing to the weapon. Other methods of affixing or adhering the band to the housing, some of which would be of a more permanent nature, such as adhering by glues and epoxies or affixing by welding, whether by conventional metal welding or sonic welding of plastics, could be used. A clipping mechanism could also be substituted for band 81, thereby providing a relatively instant removal and mounting system. The defense light is also be adaptable towards use on a rifle.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A firearm mounted illumination device, said firearm having a barrel, a trigger guard and a grip, the illumination device comprising:

a light producing bulb;

a power source;

circuitry connecting the bulb and power source;

a master switch;

a secondary switch; and a housing, composed of a rigid material, for containment of the power source, circuitry, switching mechanisms, light bulb and any other components, the housing also having an appendage, containing the secondary switch, extending along the trigger guard towards and terminating before the grip such that the secondary switch is juxtaposed to the trigger guard;

wherein the housing has an attachment means located on the opposite side of the housing from the light bulb, the attachment means being designed to attach the housing to the trigger guard of the firearm so that the housing abuts the barrel and trigger guard of the firearm.

2. The illumination device of claim 1, wherein the secondary switch is a compression type switch.

3. The illumination device of claim 1, wherein the attachment means is preformed band of rigid material which fastens around the trigger guard and into the rear of the housing.

4. The illumination device of claim 3, wherein the secondary switch is a compression switch.

5. The illumination device of claim 1, wherein the illumination device further comprises an additional low power detection and indication circuit.

6. The illumination device of claim 5, wherein the secondary switch is a compression switch.

7. The illumination device of claim 5, wherein the attachment means is preformed band of rigid material which fastens around the trigger guard and into the rear of the housing.

8. The illumination device of claim 7, wherein the secondary switch is a compression switch.

* * * * *